US008550809B2

(12) United States Patent
Uhm et al.

(10) Patent No.: US 8,550,809 B2
(45) Date of Patent: Oct. 8, 2013

(54) COMBUSTOR AND METHOD FOR CONDITIONING FLOW THROUGH A COMBUSTOR

(75) Inventors: Jong Ho Uhm, Simpsonville, SC (US); Chunyang Wu, Greer, SC (US); Jonathan Dwight Berry, Simpsonville, SC (US); Jason Thurman Stewart, Greer, SC (US)

(73) Assignee: General Electric Company, Schenectady, NY (US)

( * ) Notice: Subject to any disclaimer, the term of this patent is extended or adjusted under 35 U.S.C. 154(b) by 137 days.

(21) Appl. No.: 13/277,516

(22) Filed: Oct. 20, 2011

(65) Prior Publication Data

US 2013/0101943 A1 Apr. 25, 2013

(51) Int. Cl.
*F23D 14/62* (2006.01)

(52) U.S. Cl.
USPC ..... 431/8; 431/12; 431/354

(58) Field of Classification Search
USPC ..... 431/8, 12, 354, 350, 353; 60/737, 60/738; 239/568, 132, 548, 556
See application file for complete search history.

(56) References Cited

U.S. PATENT DOCUMENTS

| | | | |
|---|---|---|---|
| 3,771,500 | A | 11/1973 | Shakiba |
| 4,104,873 | A | 8/1978 | Coffinberry |
| 4,412,414 | A | 11/1983 | Novick et al. |
| 5,104,310 | A | 4/1992 | Saltin |
| 5,205,120 | A | 4/1993 | Obländer et al. |
| 5,213,494 | A | 5/1993 | Jeppesen |
| 5,341,645 | A | 8/1994 | Ansart et al. |
| 5,439,532 | A | 8/1995 | Fraas |
| 5,592,819 | A | 1/1997 | Ansart et al. |
| 5,707,591 | A | 1/1998 | Semedard et al. |
| 6,098,407 | A | 8/2000 | Korzendorfer et al. |
| 6,123,542 | A | 9/2000 | Joshi et al. |
| 6,394,791 | B2 | 5/2002 | Smith et al. |
| 6,438,961 | B2 | 8/2002 | Tuthill et al. |
| 6,796,790 | B2 | 9/2004 | Venizelos et al. |
| 6,983,600 | B1 | 1/2006 | Dinu et al. |
| 7,003,958 | B2 | 2/2006 | Dinu et al. |
| 7,007,478 | B2 | 3/2006 | Dinu |
| 7,631,499 | B2 | 12/2009 | Bland |
| 7,752,850 | B2 | 7/2010 | Laster et al. |
| 2004/0216463 | A1 | 11/2004 | Harris |
| 2008/0016876 | A1 | 1/2008 | Colibaba-Evulet et al. |
| 2008/0304958 | A1 | 12/2008 | Norris et al. |
| 2009/0297996 | A1 | 12/2009 | Vatsky et al. |
| 2010/0008179 | A1 | 1/2010 | Lacy et al. |
| 2010/0024426 | A1 | 2/2010 | Varatharajan et al. |
| 2010/0031662 | A1 | 2/2010 | Zuo |
| 2010/0060391 | A1 | 3/2010 | Ristola et al. |
| 2010/0084490 | A1 | 4/2010 | Zuo et al. |

(Continued)

*Primary Examiner* — Alfred Basichas
(74) *Attorney, Agent, or Firm* — Dority & Manning PA

(57) ABSTRACT

A combustor includes an end cap that extends radially across a portion of the combustor and includes an upstream surface axially separated from a downstream surface. A combustion chamber is downstream of the end cap. Premixer tubes extend from a premixer tube inlet proximate to the upstream surface through the downstream surface to provide fluid communication through the end cap and include means for conditioning flow through the plurality of premixer tubes. A method for conditioning flow through a combustor includes flowing a working fluid through a first and second set of premixer tubes that extend axially through an end cap, wherein the second set of premixer tubes includes means for conditioning flow through the second set of premixer tubes, and flowing a fuel through the first or second set of premixer tubes.

20 Claims, 5 Drawing Sheets

(56) References Cited

U.S. PATENT DOCUMENTS

| | | | | |
|---|---|---|---|---|
| 2010/0089367 | A1 | 4/2010 | Johnson et al. | |
| 2010/0095676 | A1 | 4/2010 | Uhm et al. | |
| 2010/0139280 | A1 | 6/2010 | Lacey et al. | |
| 2010/0186413 | A1 | 7/2010 | Lacey et al. | |
| 2010/0192581 | A1 | 8/2010 | Ziminsky et al. | |
| 2010/0218501 | A1 * | 9/2010 | York et al. | 60/737 |
| 2010/0236247 | A1 | 9/2010 | Davis, Jr. et al. | |
| 2010/0252652 | A1 | 10/2010 | Johnson et al. | |
| 2010/0287942 | A1 | 11/2010 | Zuo et al. | |
| 2011/0016871 | A1 | 1/2011 | Kraemer et al. | |
| 2011/0072824 | A1 | 3/2011 | Zuo et al. | |
| 2011/0073684 | A1 | 3/2011 | Johnson et al. | |
| 2011/0083439 | A1 | 4/2011 | Zuo et al. | |
| 2011/0089266 | A1 | 4/2011 | Stoia et al. | |

* cited by examiner

COMBUSTOR AND METHOD FOR CONDITIONING FLOW THROUGH A COMBUSTOR

FIELD OF THE INVENTION

The present invention generally involves a combustor and method for conditioning flow through the combustor. In particular embodiments of the present invention, the combustor and method may be used to normalize the flow of a working fluid through the combustor.

BACKGROUND OF THE INVENTION

Combustors are commonly used in industrial and power generation operations to ignite fuel to produce combustion gases having a high temperature and pressure. For example, gas turbines typically include one or more combustors to generate power or thrust. A typical gas turbine used to generate electrical power includes an axial compressor at the front, one or more combustors around the middle, and a turbine at the rear. Ambient air may be supplied to the compressor, and rotating blades and stationary vanes in the compressor progressively impart kinetic energy to the working fluid (air) to produce a compressed working fluid at a highly energized state. The compressed working fluid exits the compressor and flows through one or more nozzles into a combustion chamber in each combustor where the compressed working fluid mixes with fuel and ignites to generate combustion gases having a high temperature and pressure. The combustion gases expand in the turbine to produce work. For example, expansion of the combustion gases in the turbine may rotate a shaft connected to a generator to produce electricity.

Various design and operating parameters influence the design and operation of combustors. For example, higher combustion gas temperatures generally improve the thermodynamic efficiency of the combustor. However, higher combustion gas temperatures also promote flashback or flame holding conditions in which the combustion flame migrates towards the fuel being supplied by the nozzles, possibly causing severe damage to the nozzles in a relatively short amount of time. In addition, higher combustion gas temperatures generally increase the disassociation rate of diatomic nitrogen, increasing the production of nitrogen oxides ($NO_x$). Conversely, a lower combustion gas temperature associated with reduced fuel flow and/or part load operation (turndown) generally reduces the chemical reaction rates of the combustion gases, increasing the production of carbon monoxide and unburned hydrocarbons. Therefore, continued improvements in the designs and methods for conditioning flow through the combustor would be useful to enhancing the thermodynamic efficiency of the combustor, protecting the combustor from catastrophic damage, and/or reducing undesirable emissions over a wide range of combustor operating levels.

BRIEF DESCRIPTION OF THE INVENTION

Aspects and advantages of the invention are set forth below in the following description, or may be obvious from the description, or may be learned through practice of the invention.

One embodiment of the present invention is a combustor that includes an end cap that extends radially across at least a portion of the combustor. The end cap includes an upstream surface axially separated from a downstream surface. A combustion chamber is downstream of the end cap. A plurality of premixer tubes extend from a premixer tube inlet proximate to the upstream surface through the downstream surface of the end cap to provide fluid communication through the end cap to the combustion chamber and include means for conditioning flow through the plurality of premixer tubes.

Another embodiment of the present invention is a combustor that includes an end cap that extends radially across at least a portion of the combustor. The end cap includes an upstream surface axially separated from a downstream surface. A shroud circumferentially surrounds at least a portion of the end cap and at least partially defines a fuel plenum between the upstream surface and the downstream surface. A plurality of premixer tubes extend through the upstream and downstream surfaces of the end cap and include a premixer tube inlet and means for conditioning flow through the plurality of premixer tubes.

The present invention may also include a method for conditioning flow through a combustor that includes flowing a working fluid through a first set of premixer tubes that extend axially through an end cap that extends radially across at least a portion of the combustor, flowing the working fluid through a second set of premixer tubes that extend axially through the end cap, wherein the second set of premixer tubes includes means for conditioning flow through the second set of premixer tubes, and flowing a fuel through at least one of the first or second set of premixer tubes.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
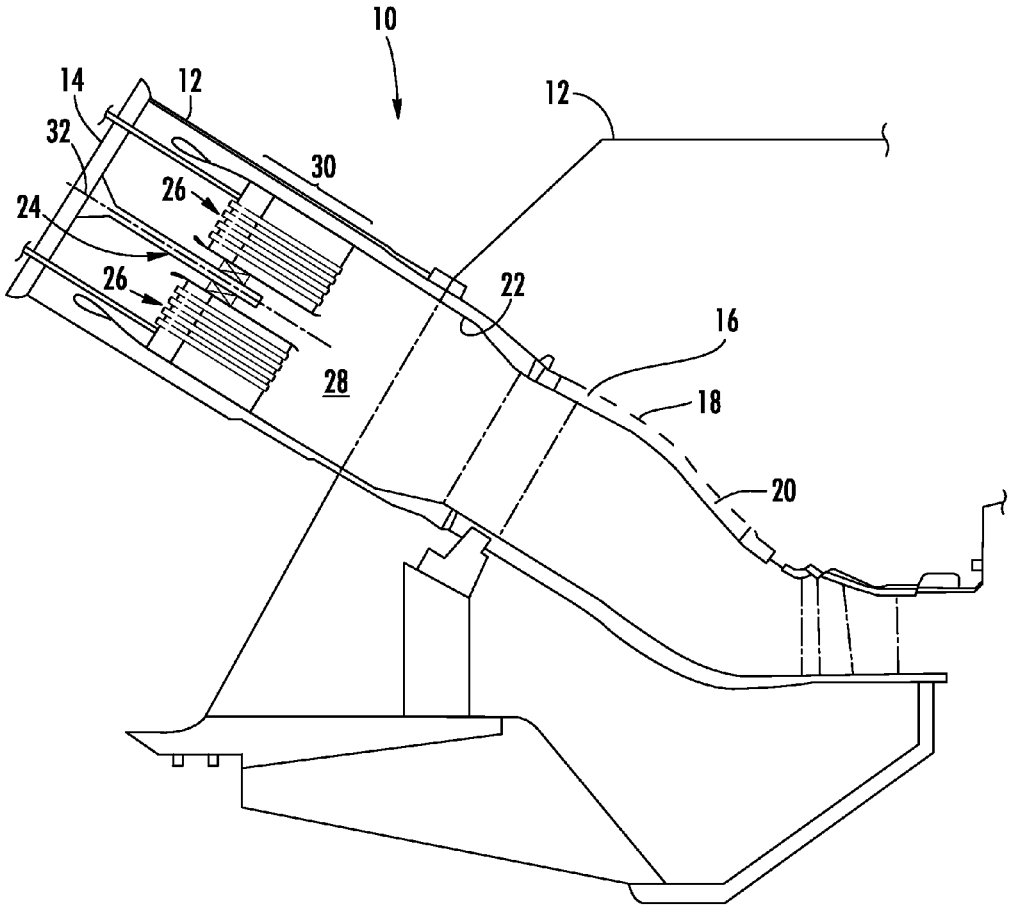
FIG. 1 is a simplified cross-section view of an exemplary combustor according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a combustor and method for conditioning flow through the combustor. Baseline computational fluid dynamic calculations indicate that the working fluid flowing through the combustor may become stratified, resulting in local flow overfed regions. In particular, repetitive geometries that exist in the combustor may create high flow regions near boundaries or divisions. As a result, particular embodiments of the present invention seek to reduce the local flow overfed regions to normalize the working fluid flow radially across the combustor. Although exemplary embodiments of the present invention will be described generally in the context of a combustor incorporated into a gas turbine for purposes of illustration, one of ordinary skill in the art will readily appreciate that embodiments of the present invention may be applied to any combustor and are not limited to a gas turbine combustor unless specifically recited in the claims.

FIG. 1 shows a simplified cross-section of an exemplary combustor 10, such as would be included in a gas turbine, according to one embodiment of the present invention. A casing 12 and end cover 14 may surround the combustor 10 to contain a working fluid flowing to the combustor 10. The working fluid passes through flow holes 16 in an impingement sleeve 18 to flow along the outside of a transition piece 20 and liner 22 to provide convective cooling to the transition piece 20 and liner 22. When the working fluid reaches the end cover 14, the working fluid reverses direction to flow through one or more fuel nozzles 24 and/or premixer tubes 26 into a combustion chamber 28.

The one or more fuel nozzles 24 and premixer tubes 26 are radially arranged in an end cap 30 upstream from the combustion chamber 28. As used herein, the terms "upstream" and "downstream" refer to the relative location of components in a fluid pathway. For example, component A is upstream from component B if a fluid flows from component A to component B. Conversely, component B is downstream from component A if component B receives a fluid flow from component A. Various embodiments of the combustor 10 may include different numbers and arrangements of fuel nozzles 24 and premixer tubes 26. For example, in the embodiment shown in FIG. 1, the combustor 10 includes a single fuel nozzle 24 aligned with an axial centerline 32 of the combustor 10, and the premixer tubes 26 surround the single fuel nozzle 24 and extend radially outward in the end cap 30.

The fuel nozzle 24 extends through the end cap 30 and provides fluid communication through the end cap 30 to the combustion chamber 28. The fuel nozzle 24 may comprise any suitable structure known to one of ordinary skill in the art for mixing fuel with the working fluid prior to entry into the combustion chamber 28, and the present invention is not limited to any particular structure or design unless specifically recited in the claims. For example, as shown more clearly in FIG. 2, the fuel nozzle 24 may comprise a center body 34 and a bellmouth opening 36. The center body 34 provides fluid communication for fuel to flow from the end cover 14, through the center body 34, and into the combustion chamber 28. The bellmouth opening 36 surrounds at least a portion of the center body 34 to define an annular passage 38 between the center body 34 and the bellmouth opening 36. In this manner, the working fluid may flow through the annular passage 38 to mix with the fuel from the center body 34 prior to reaching the combustion chamber 28. If desired, the fuel nozzle 24 may further include one or more swirler vanes 40 that extend radially between the center body 34 and the bellmouth opening 36 to impart swirl to the fuel-working fluid mixture prior to reaching the combustion chamber 28.

Figure 2:
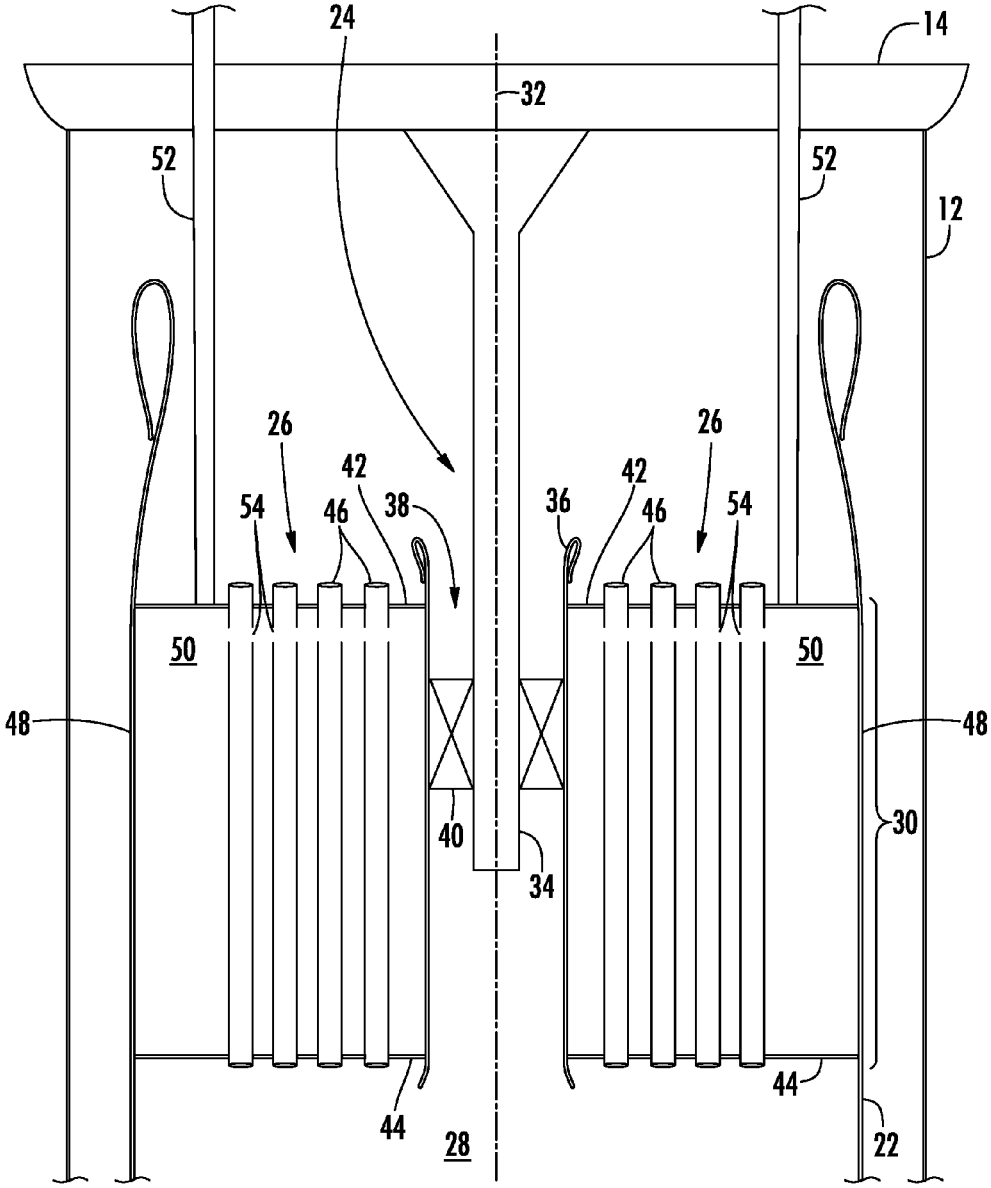
FIG. 2 is an enlarged cross-section view of a portion of the combustor shown in FIG. 1 according to one embodiment of the present invention.

FIG. 2 provides an enlarged cross-section of a portion of the combustor 10 shown in FIG. 1 according to one embodiment of the present invention. As shown in FIG. 2, the end cap 30 extends radially across at least a portion of the combustor 10 and generally includes an upstream surface 42 axially separated from a downstream surface 44. Each premixer tube 26 includes a premixer tube inlet 46 proximate to the upstream surface 42 and extends through the downstream surface 44 of the end cap 30 to provide fluid communication for the working fluid to flow through the end cap 30 and into the combustion chamber 28. Although shown as cylindrical tubes, the cross-section of the premixer tubes 26 may be any geometric shape, and the present invention is not limited to any particular cross-section unless specifically recited in the claims. A shroud 48 circumferentially surrounds at least a portion of the end cap 30 to partially define a fuel plenum 50 between the upstream and downstream surfaces 42, 44.

A fuel conduit 52 may extend from the end cover 14 through the upstream surface 42 of the end cap 30 to provide fluid communication for fuel to flow from the end cover 14, through the fuel conduit 52, and into the fuel plenum 50. One or more of the premixer tubes 26 may include a fuel port 54 that provides fluid communication through the one or more premixer tubes 26 from the fuel plenum 50. The fuel ports 54 may be angled radially, axially, and/or azimuthally to project and/or impart swirl to the fuel flowing through the fuel ports 54 and into the premixer tubes 26. In this manner, the working fluid may flow through the premixer tube inlets 46 and into the premixer tubes 26, and fuel from the fuel conduit 52 may flow through the fuel plenum 50 and fuel ports 54 and into the premixer tubes 26 to mix with the working fluid. The fuel-working fluid mixture may then flow through the premixer tubes 26 and into the combustion chamber 28.

Figure 3:
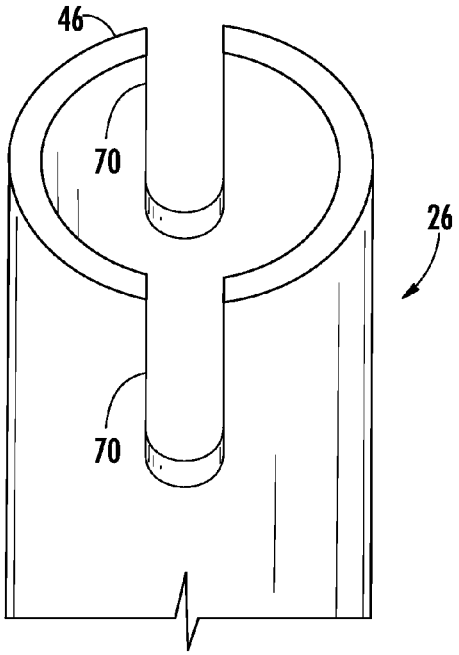
FIGS. 3-10 are enlarged perspective views of the premixer tube inlets according to various embodiments of the present invention.
Figure 4:
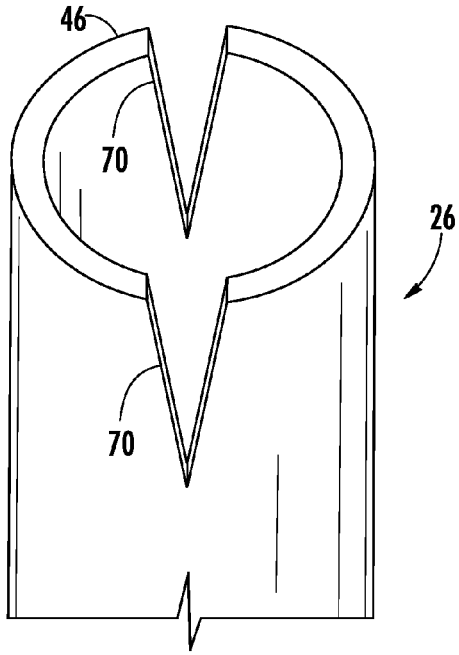
Figure 5:
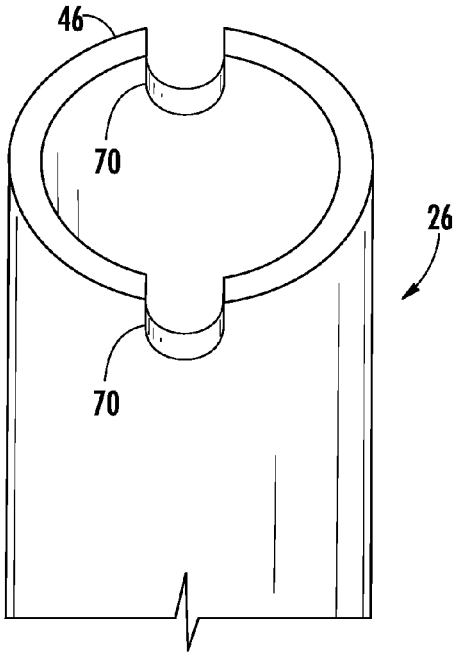
Figure 6:
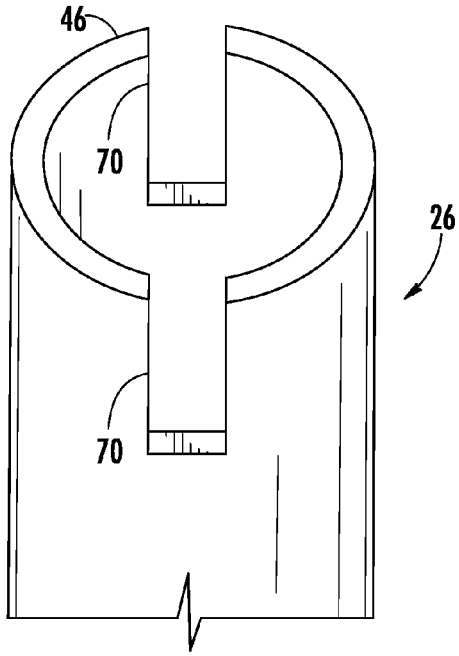
Figure 7:
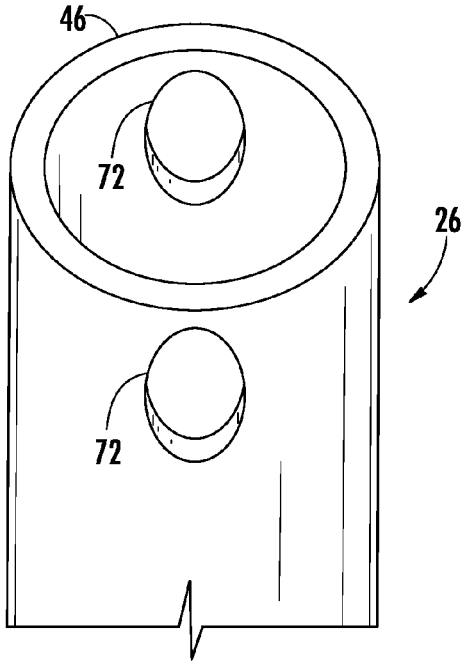
Figure 8:
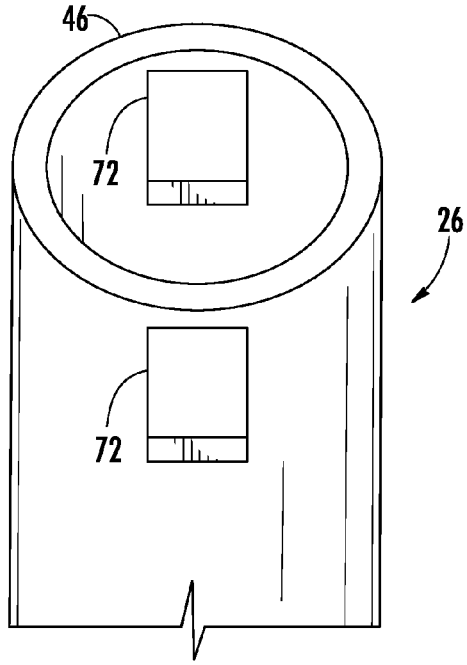
Figure 9:
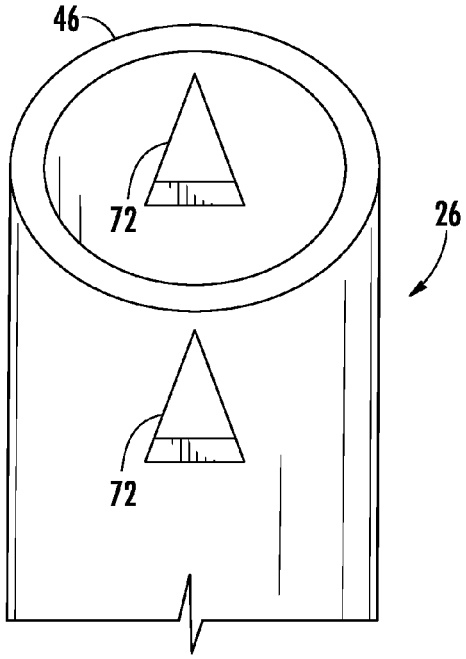
Figure 10:
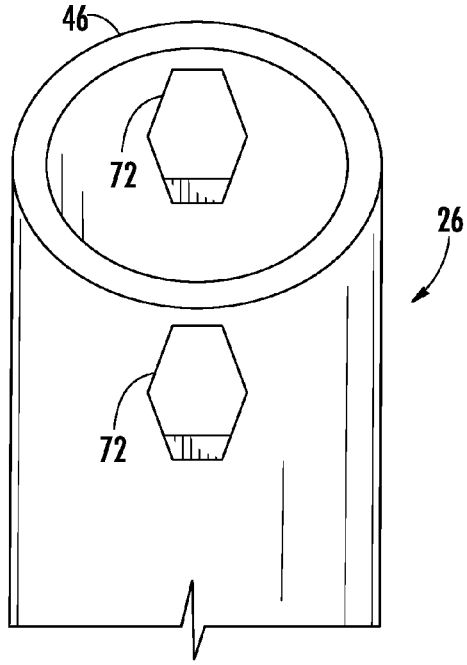

FIGS. 3-10 provide enlarged perspective views of premixer tube inlets 46 according to various embodiments of the present invention. As shown, individual premixer tubes 26 may include various means for conditioning flow through the premixer tubes 26, and thus the combustor 10. For example, as shown in FIGS. 3-6, the means for conditioning flow through the premixer tubes 26 may comprise one or more slots 70 in the premixer tube inlets 46. Alternately, as shown in FIGS. 7-10, the means for conditioning flow through the premixer tubes may comprise one or more apertures 72 proximate to the premixer tube inlets 46. As shown in FIGS. 3-10, the slots 70 and apertures 72 may take any geometric shape, and the present invention is not limited to any particular cross-section or shape of slots 70 or apertures 72 unless specifically recited in the claims. For example, the slots 70 may have a rounded bottom at various depths, as shown in FIGS. 3 and 5. Alternately, the slots 70 may have a pointed bottom, as shown in FIG. 4, or a flat bottom, as shown in FIG. 6. Similarly, the apertures 72 may have an arcuate or polygonal shape, as shown in FIGS. 7-10. Computational fluid dynamic models indicate that the slots 70 or apertures 72 in or proximate to the premixer tube inlet 46 will reduce the mass flow rate of the working fluid through the individual premixer tube 26. As a result, the width, depth, number, and placement of premixer tubes 26 having slots 70 or apertures 72 may be readily determined so that one or more premixer tubes 26 having means for conditioning flow through the premixer tubes 26 may be located in local flow overfed regions to normalize the working fluid flow radially across the combustor 10.

Figure 11:
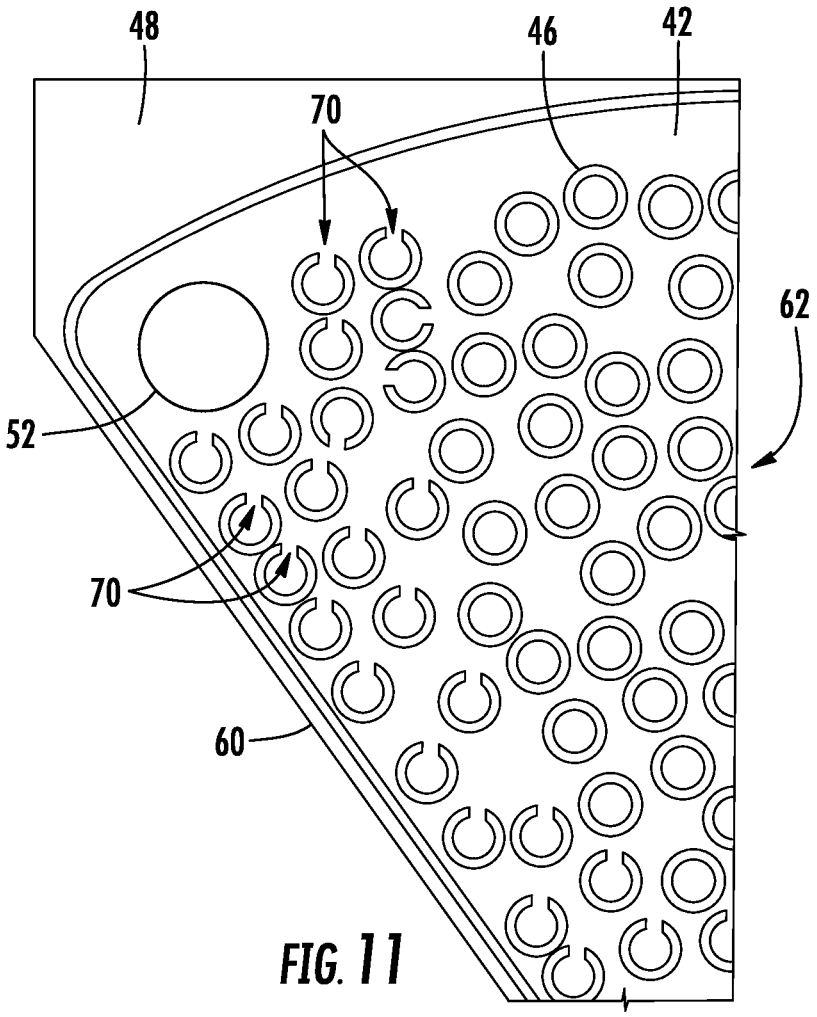
FIG. 11 is a downstream plan view of a portion of the upstream surface of the end cap shown in FIGS. 1-2.

By way of example, FIG. 11 provides a downstream plan view of a portion of the upstream surface 42 of the end cap 30 shown in FIGS. 1 and 2. As shown, the combustor 10 includes a vertical baffle 60 that separates the premixer tubes 26 into groups 62. In this particular example, the computational fluid dynamic model indicates a high flow region generally adjacent to the baffle 60 and fuel conduit 52. As a result, slots 70 have been added to the premixer tubes 26 adjacent to the baffle 60 and fuel conduit 52 to reduce the mass flow rate of the working fluid in this previous high flow region, thus normalizing the mass flow rate of the working fluid radially across the end cap 30. One of ordinary skill in the art may readily determine the optimum location, orientation, size, and number of slots 70 and/or apertures 72 without undue experimentation.

The combustor 10 described and illustrated with respect to FIGS. 1-11 may thus provide a method for conditioning flow through the combustor 10. As previously described, the method generally includes flowing a portion of the working fluid through a first set of premixer tubes 26 (without slots 70 or apertures 72) that extend axially through the end cap 30, flowing a portion of the working fluid through a second set of premixer tubes 26 (with slots 70 or apertures 72) that extend axially through the end cap 30, and flowing a fuel through at least one of the first or second set of premixer tubes 26. In particular embodiments, the method may further include separating the premixer tubes 26 into groups 62 using a baffle 60 and/or independently adjusting the fuel type and/or flow rate through the various groups 62 of premixer tubes 26. In other embodiments, the method may include flowing the fuel through the fuel nozzle 24 that extends axially through the end cap 30.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A combustor, comprising:

a. an end cap that extends radially across at least a portion of the combustor, wherein the end cap comprises an upstream surface axially separated from a downstream surface;

b. a combustion chamber downstream of the end cap;

c. a plurality of premixer tubes that extend from a premixer tube inlet proximate to the upstream surface through the downstream surface of the end cap, wherein each premixer tube provides fluid communication through the end cap to the combustion chamber;

d. means for conditioning flow through the plurality of premixer tubes adjacent to the premixer tube inlet.

2. The combustor as in claim 1, wherein the means for conditioning flow through the plurality of premixer tubes comprises one or more slots in one or more premixer tube inlets.

3. The combustor as in claim 2, wherein the slots have at least one of a rounded, pointed, or flat shape.

4. The combustor as in claim 1, wherein the means for conditioning flow through the plurality of premixer tubes comprises one or more apertures adjacent to one or more premixer tube inlets.

5. The combustor as in claim 4, wherein the apertures have at least one of an arcuate or polygonal shape.

6. The combustor as in claim 1, further comprising a shroud that circumferentially surrounds at least a portion of the end cap, wherein the shroud at least partially defines a fuel plenum between the upstream surface and the downstream surface.

7. The combustor as in claim 1, further comprising a fuel conduit that extends through the upstream surface of the end cap.

8. The combustor as in claim 1, further comprising a fuel port that extends through one or more premixer tubes downstream from the means for conditioning flow through the plurality of premixer tubes, wherein each fuel port provides fluid communication through the one or more premixer tubes.

9. The combustor as in claim 1, further comprising a fuel nozzle extending through the end cap, wherein the fuel nozzle provides fluid communication through the end cap to the combustion chamber.

10. A combustor, comprising:

a. an end cap that extends radially across at least a portion of the combustor, wherein the end cap comprises an upstream surface axially separated from a downstream surface;

b. a shroud that circumferentially surrounds at least a portion of the end cap, wherein the shroud at least partially defines a fuel plenum between the upstream surface and the downstream surface;

c. a plurality of premixer tubes that extend through the upstream and downstream surfaces of the end cap, wherein each premixer tube includes a premixer tube inlet; and d. means for conditioning flow through the plurality of premixer tubes adjacent to the premixer tube inlet.

11. The combustor as in claim 10, wherein the means for conditioning flow through the plurality of premixer tubes comprises one or more slots in one or more premixer tube inlets.

12. The combustor as in claim 11, wherein the slots have at least one of a rounded, pointed, or flat shape.

13. The combustor as in claim 10, wherein the means for conditioning flow through the plurality of premixer tubes comprises one or more apertures adjacent to one or more premixer tube inlets.

14. The combustor as in claim 13, wherein the apertures have at least one of an arcuate or polygonal shape.

15. The combustor as in claim 10, further comprising a fuel port that extends through one or more premixer tubes downstream from the means for conditioning flow through the plurality of premixer tubes, wherein each fuel port provides fluid communication through the one or more premixer tubes.

16. The combustor as in claim 10, further comprising a fuel nozzle extending through the upstream surface and the downstream surface of the end cap, wherein the fuel nozzle provides fluid communication through the end cap.

17. A method for conditioning flow through a combustor, comprising:

a. flowing a working fluid through a first set of premixer tubes that extend axially through an end cap that extends radially across at least a portion of the combustor;

b. flowing the working fluid through a second set of premixer tubes that extend axially through the end cap, wherein the second set of premixer tubes includes a premixer tube inlet and means for conditioning flow through the second set of premixer tubes adjacent to the premixer tube inlet; and c. flowing a fuel through at least one of the first or second set of premixer tubes.

18. The method as in claim 17, further comprising flowing the fuel through a fuel nozzle that extends axially through the end cap.

19. The method as in claim 17, further comprising separating the premixer tubes into groups.

20. The method as in claim 19, further comprising adjusting the fuel flow rate through the groups of premixer tubes.

* * * * *